US007826767B2

(12) United States Patent
Sato et al.

(10) Patent No.: US 7,826,767 B2
(45) Date of Patent: Nov. 2, 2010

(54) PROCESS CARTRIDGE, IMAGE FORMING APPARATUS AND DEVELOPING CARTRIDGE

(75) Inventors: Fumikazu Sato, Konan (JP); Naoya Kamimura, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 59 days.

(21) Appl. No.: 12/341,052

(22) Filed: Dec. 22, 2008

(65) Prior Publication Data

US 2009/0169257 A1 Jul. 2, 2009

(30) Foreign Application Priority Data

Dec. 28, 2007 (JP) ..... 2007-340752

(51) Int. Cl.
*G03G 21/18* (2006.01)

(52) U.S. Cl. ..... 399/113; 399/111

(58) Field of Classification Search ..... 399/113, 399/111

See application file for complete search history.

(56) References Cited

U.S. PATENT DOCUMENTS

| | | | | |
|---|---|---|---|---|
| 5,752,134 | A * | 5/1998 | Hazama et al. | 399/113 |
| 6,101,350 | A | 8/2000 | Suzuki et al. | |
| 6,163,666 | A * | 12/2000 | Hosokawa et al. | 399/111 |
| 6,751,428 | B2 * | 6/2004 | Okabe | 399/111 |
| 2006/0029423 | A1 * | 2/2006 | Shiraki | 399/113 |
| 2007/0058993 | A1 * | 3/2007 | Horinoe | 399/113 X |
| 2008/0310881 | A1 * | 12/2008 | Sato | 399/111 |

FOREIGN PATENT DOCUMENTS

| | | |
|---|---|---|
| JP | 04-052760 | 12/1992 |
| JP | 2000-250310 | 9/2000 |

* cited by examiner

*Primary Examiner*—Sophia S Chen
(74) *Attorney, Agent, or Firm*—Banner & Witcoff, Ltd.

(57) ABSTRACT

A process cartridge includes a developing cartridge including a developer carrier, a fitting part, and a pressed part, and a photosensitive cartridge, to which the developing cartridge is removably mounted. The photosensitive cartridge includes a photosensitive member, a positioning part which is fitted into the fitting part for positioning the developing cartridge, and a pressing part which contacts the pressed part for pressing the developing cartridge toward the photosensitive member, wherein the positioning part and the pressing part are provided longitudinally in an area in a longitudinal direction of the photosensitive member corresponding to an area on the photosensitive member in which a developer image is formed.

15 Claims, 8 Drawing Sheets

PROCESS CARTRIDGE, IMAGE FORMING APPARATUS AND DEVELOPING CARTRIDGE

CROSS-REFERENCE TO RELATED APPLICATIONS

This application claims priority from Japanese Patent Application No. 2007-340752 filed on Dec. 28, 2007, the entire subject matter of which is incorporated herein by reference.

TECHNICAL FIELD

Aspects of the invention relate to an image forming apparatus, a process cartridge that is removably mounted to the image forming apparatus, and a developing cartridge provided for the process cartridge.

BACKGROUND

There has been proposed a related art printer that forms an image electrophotographically, to which a process cartridge can be removably mounted. The process cartridge includes a developing cartridge having a developing roller and a photosensitive cartridge having a photosensitive drum. The developing cartridge is removably mounted to the photosensitive cartridge.

For example, JP-A-2000-250310 describes a related art photosensitive cartridge in which upwardly protruding rotatable rolls are provided at two positions on both the right and left ends of the bottom wall of a case, and urging member is rotatably provided to be able to expand or contract on the inner surface of both the right and left side walls of the case.

If the related art developing cartridge is mounted to the photosensitive cartridge, the rolls receive the case of the developing cartridge at the portions on the lower surface of a downwardly directed, convex curved toner accommodating chamber to reduce unsteadiness of the case.

Further, action parts projecting from both the right and left outsides of the toner accommodating chamber are formed on the case of the developing cartridge, whereby if the developing cartridge is mounted to the photosensitive cartridge, the urging member presses the action parts to press the developing roller via the developing cartridge against the photosensitive member drum.

SUMMARY

Illustrative aspects of the invention provide a process cartridge that can be reduced in size, an image forming apparatus on which the process cartridge is mounted, and a developing cartridge provided in the process cartridge.

BRIEF DESCRIPTION OF THE DRAWINGS

FIGS. 8A and 8B are left side views of the developing cartridge of FIG. 5, in which FIG. 8A shows a state in which a gear cover is attached, and FIG. 8B shows a state in which the gear cover is detached.

DETAILED DESCRIPTION

<General Overview>

Figure 1:
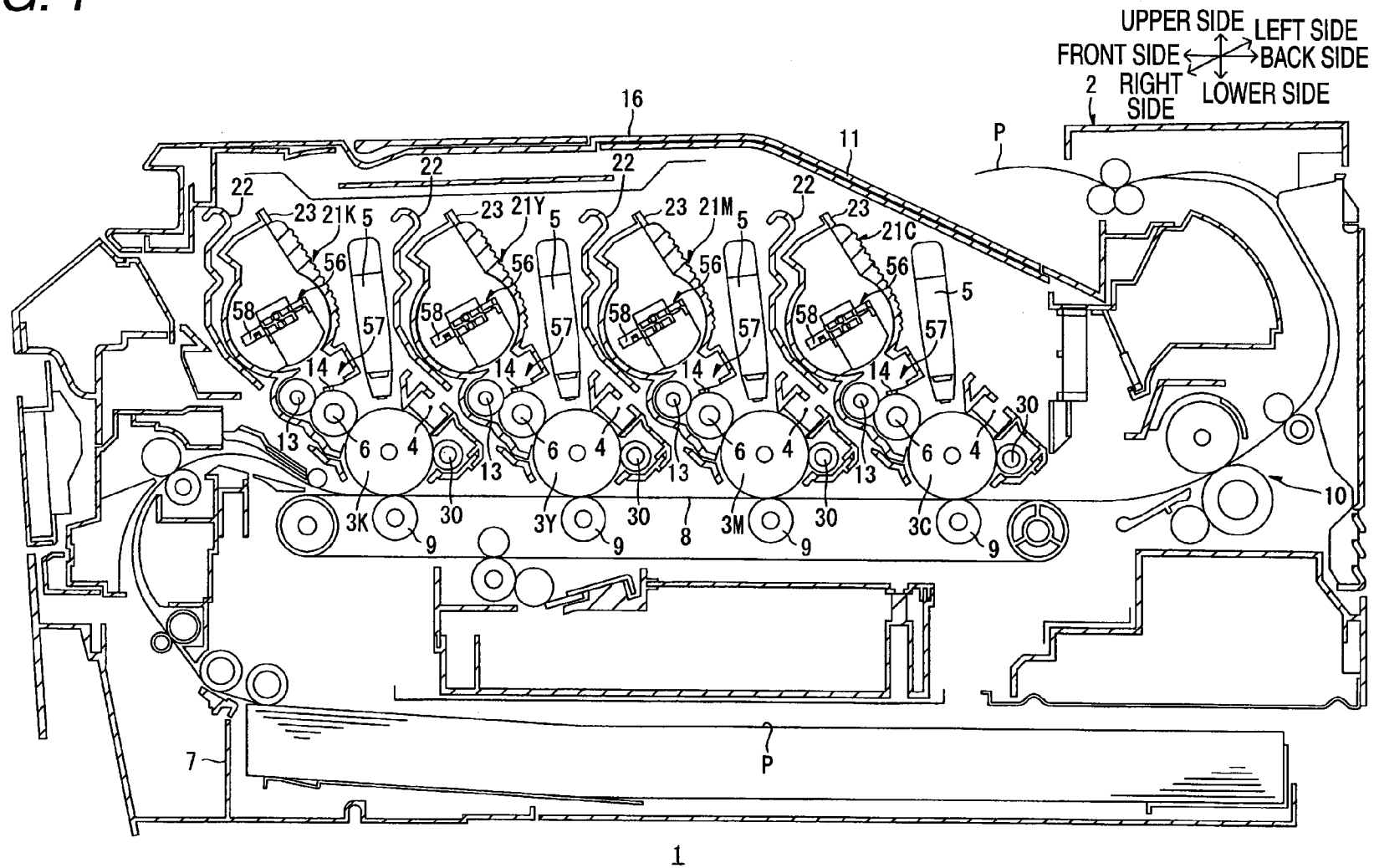
FIG. 1 is a cross-sectional side view showing an image forming apparatus according to an exemplary embodiment of the invention.

The related art process cartridge described above has some disadvantages. For example, the upwardly protruding rolls contact the case of the developing cartridge at portions on the lower surface of the downwardly directed, convex curved toner accommodating chamber. Therefore, the case of the developing cartridge is received in the case of the photosensitive cartridge in a floating state from the bottom wall of the case of the photosensitive cartridge owing to the upwardly protruding rolls. As a result, a size of the process cartridge is increased in the up-down direction by the amount of space between the rolls and the bottom wall of the case of the photosensitive cartridge.

Further, in the related art process cartridge, the urging member presses the action parts of the developing cartridge on both the right and left outsides of the case of the developing cartridge. Therefore, the case of the developing cartridge is received within the case of the photosensitive cartridge in a state in which there is a clearance generated by an amount that the action parts project from the case of the photosensitive cartridge. As a result, a size of the process cartridge is increased in the right-left direction by the amount of space between the case of the photosensitive cartridge and the developing cartridge owing to the action parts.

Accordingly, illustrative aspects of the invention provide a process cartridge that can be reduced in size, an image forming apparatus on which the process cartridge is mounted, and a developing cartridge provided in the process cartridge.

According to a first illustrative aspect of the invention, there is provided a process cartridge comprising: a developing cartridge comprising a developer carrier, a fitting part, and a pressed part; and a photosensitive cartridge, to which the developing cartridge is removably mounted, the photosensitive cartridge comprising: a photosensitive member; a positioning part which is fitted into the fitting part for positioning the developing cartridge; and a pressing part which contacts the pressed part for pressing the developing cartridge toward the photosensitive member, wherein the positioning part and the pressing part are provided longitudinally in an area in a longitudinal direction of the photosensitive member corresponding to an area on the photosensitive member in which a developer image is formed.

According to a second illustrative aspect of the invention, there is provided an image forming apparatus comprising: the process cartridge according to the first illustrative aspect; and a main body.

According to a third illustrative aspect of the invention, there is provided a developing cartridge comprising: a housing; a developer carrier; a fitting part that is provided at the center in a widthwise direction of the housing and is recessed within the housing for positioning the developing cartridge;

and a pressed part that is provided between the fitting part and a side of the developing cartridge to receive a pressing force.

According to a fourth illustrative aspect of the invention, there is provided a photosensitive cartridge comprising: a front wall; a back wall; two front side walls, one front side wall provided on each side of the front wall and attached to the front wall; two back side walls, one back side wall provided on each side of the back wall and each of the two back side walls attached to a respective one of the two front side walls and to the back wall; a photosensitive member supported in the photosensitive cartridge by the two back side walls; a positioning part which is recessed in the front wall in a widthwise direction of the front wall; and a pressing part which is positioned between the positioning part and one of the front side walls and attached to the front wall on a side of the front wall facing the photosensitive member.

<Exemplary Embodiments>

Exemplary embodiments of the invention will now be described with reference to the drawings.

(Image Forming Apparatus)

FIG. 1 is a cross-sectional side view showing an image forming apparatus according to an exemplary embodiment of the invention. In the descriptions that follow, directions as used herein refer to directions indicated by the arrows as indicated in each figure. The right-left direction and the width direction are equivalent.

A color printer is one example of the image forming apparatus 1. Four photosensitive drums 3 are disposed in parallel along the front-back direction within a body casing 2. The body casing is one example of an image forming apparatus main body of the image forming apparatus 1, and the photosensitive drum is one example of a photosensitive member, as shown in FIG. 1. Although four photosensitive drums 3 are described, it is possible to have more or fewer photosensitive drums 3, depending on an amount of colors used in the image forming apparatus 1.

In the following, the four photosensitive drums 3 are distinguished, according to a color of the developer contained therein, as a photosensitive drum 3K (black), a photosensitive drum 3Y (yellow), a photosensitive drum 3M (magenta) and a photosensitive drum 3C (cyan) and thus correspond to the four colors (e.g., black, yellow, magenta and cyan) of a developer image (hereinafter described). In each photosensitive drum 3, a scorotron-type charger 4, a light emitting diode (LED) unit 5 and a developing roller 6 are disposed oppositely. The developing roller is one example of a developer carrier.

The surface of the photosensitive drum 3 is uniformly charged by the scorotron-type charger 4, and then exposed by an LED (not shown) provided in the LED unit 5. Thereby, an electrostatic latent image based on image data is formed on the surface of each photosensitive drum 3. Each electrostatic latent image is visualized by developer carried on the developing roller 6 to form the developer image on the surface of the photosensitive drum 3.

A sheet P is stored in a sheet feed cassette 7 within the body casing 2. The sheet P stored in the sheet feed cassette 7 is fed to a conveying belt 8 by various kinds of rollers.

The conveying belt 8 is disposed between each photosensitive drum 3K, 3Y, 3M and 3C and a respective transfer roller 9 opposed thereto. The developer image on the surface of each photosensitive drum 8 is transferred onto the sheet P conveyed on the conveying belt 8 by a transfer bias applied to the transfer roller 9, and superimposed successively.

The sheet P onto which the developer images of four colors are transferred is conveyed to a fixing part 10. The developer images transferred onto the sheet P are thermally fixed by the fixing part 10. Thereafter, the sheet P is discharged onto a sheet discharge tray 11 by various kinds of rollers.

(Process Cartridge)

The image forming apparatus 1 includes the four process cartridges 21 corresponding to the four colors. In the following, the four process cartridges 21 are distinguished as a process cartridge 21K (black), a process cartridge 21Y (yellow), a process cartridge 21M (magenta) and a process cartridge 21C (cyan), corresponding to the four colors. As with the photosensitive drums 3, a number of the process cartridges may be more or fewer depending on the number of colors used in the image forming apparatus 1.

The process cartridges 21 are removably mounted within the body casing 2, and disposed in parallel along the front-back direction.

That is, a top cover 16 is provided on an upper wall of the body casing 2 in a manner that the top cover 16 can be freely opened or closed, whereby each process cartridge 21 is removably mounted to the body casing 2 by opening the top cover 16.

Figure 2:
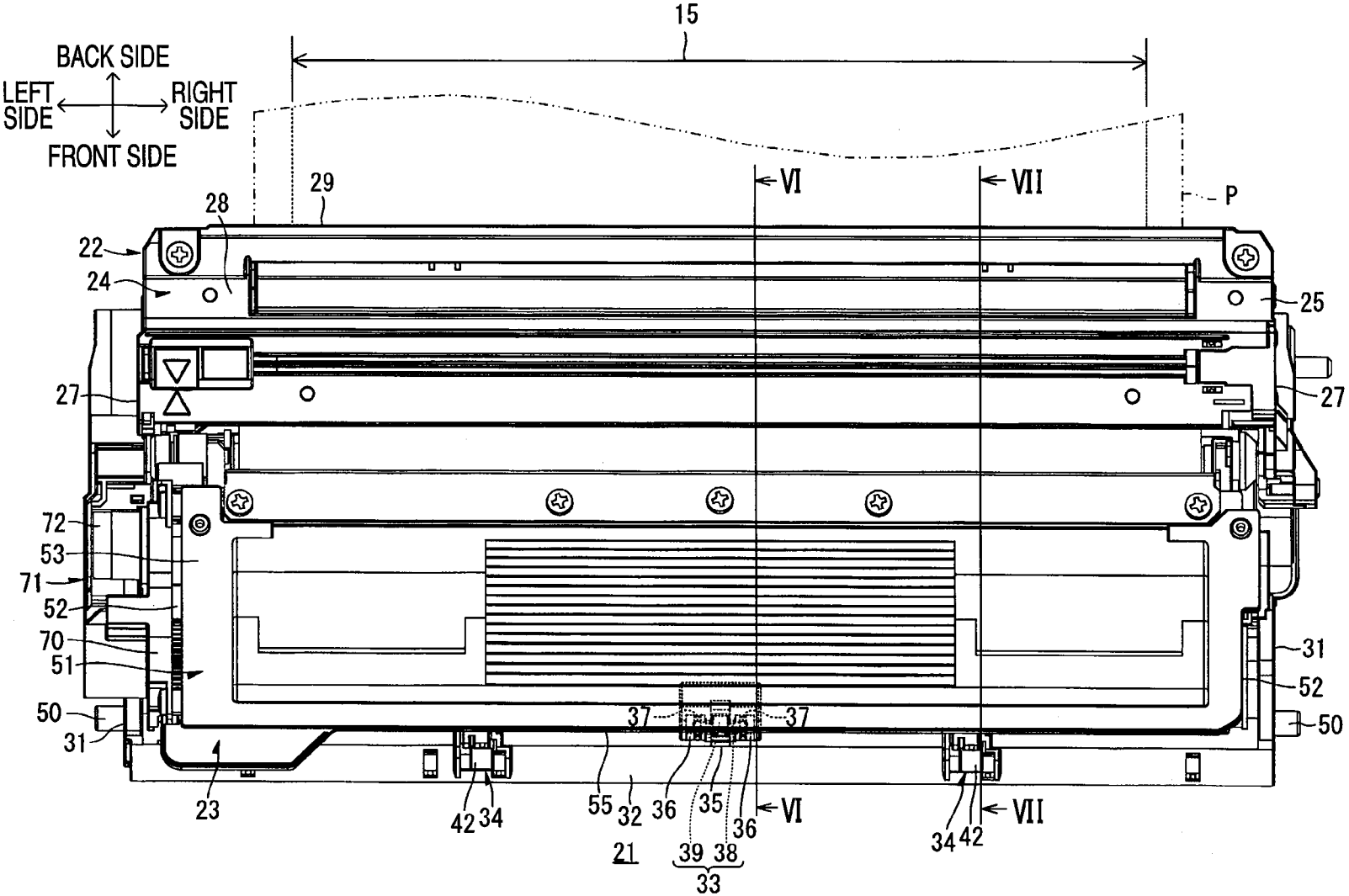
FIG. 2 is a plan view of a process cartridge of the image forming apparatus of FIG. 1.
Figure 3:
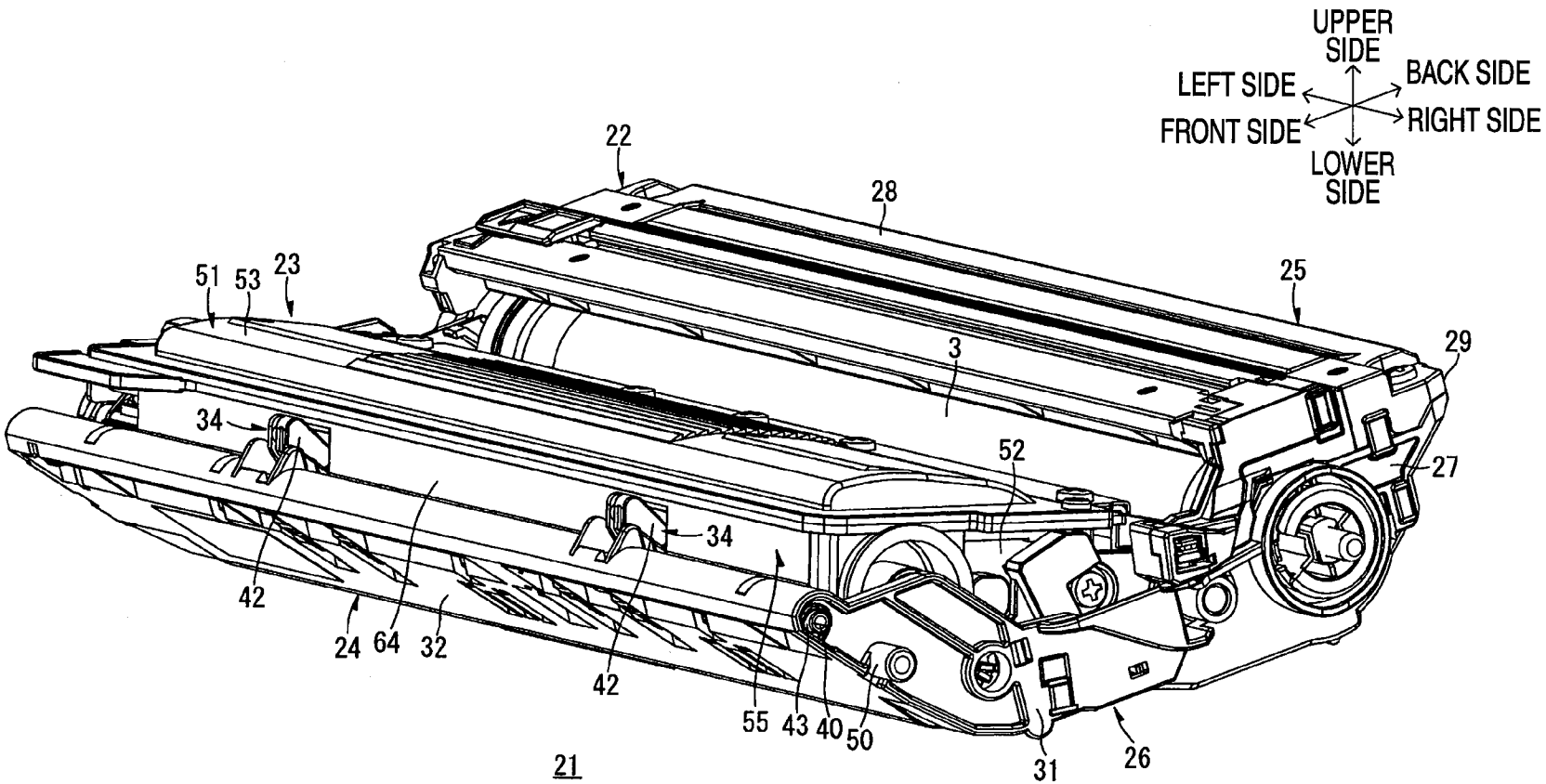
FIG. 3 is a perspective view of the process cartridge as shown in FIG. 2, as viewed from a right front side.

The process cartridge 21 comprises a drum cartridge 22, as one example of the photosensitive cartridge, and a developing cartridge 23 removably mounted to the drum cartridge 22, as shown in FIGS. 2 and 3.

(1) Drum Cartridge

Figure 4:
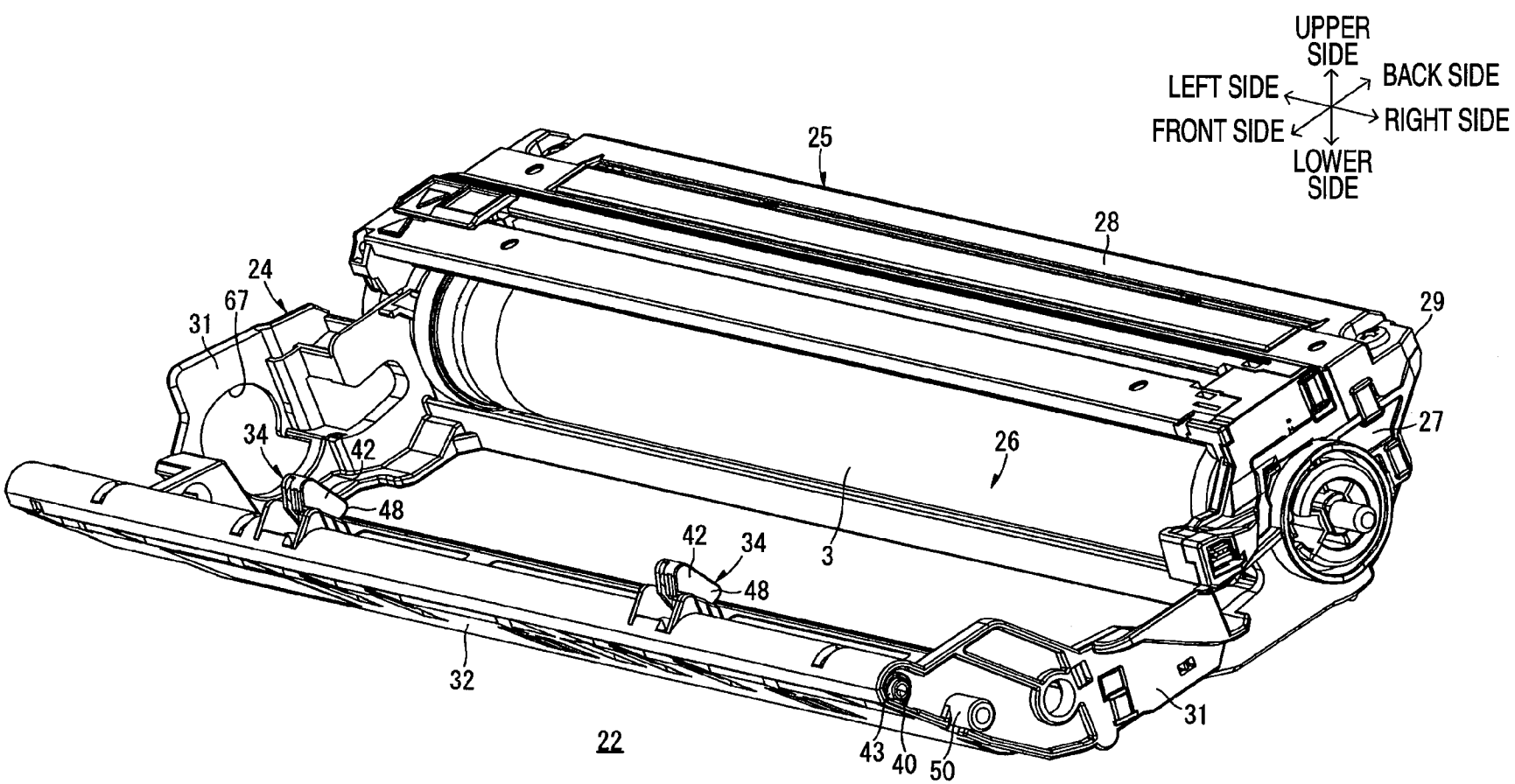
FIG. 4 is a perspective view of a drum cartridge of the process cartridge of FIG. 3, as viewed from the right front side.

The drum cartridge 22 comprises a drum frame 24, as shown in FIG. 4. The drum frame 24 comprises a drum support part 25 and a developing cartridge housing part 26. The drum support part 25 comprises a plurality of back side walls 27 disposed on opposite sides of the developing cartridge 22 with a gap between the back side walls 27 in the width direction, and an upper wall 28 built between the upper end portions of the back side walls 27.

The photosensitive drum 3 is rotatably supported between the back side walls 27, as shown in FIGS. 1 and 4. The scorotron-type charger 4 is provided along the upper wall 28. A back wall 29 is provided in a back end portion of the upper wall 28 and a cleaning roller 30 is provided along the back wall 29.

The developing cartridge housing part 26 comprises a plurality of front side walls 31 disposed on opposite sides of the developing cartridge 22 with a gap between the front side walls 31 in the width direction so that the developing cartridge 23 may be removably mounted therebetween, and a front wall 32 built between the front portions of the front side walls 31.

The front side walls 31 are formed continuously with the back side walls 27. That is, on each side of the developing cartridge 22, the front side wall 31 is continuous with the back side wall 27. A rear portion of each front side wall 31 is formed to extend forward from under the front end portion of each back side wall 27, and a front portion of each front side wall 31 is formed to extend obliquely upward from the rear portion to the front.

The rear portion of the left front side wall 31 is formed with an input gear opening portion 67 for exposing an input gear 72 (hereinafter described) to the left.

The front wall 32 is disposed on an opposite side of the developing roller 6 from the photosensitive drum 3, when the developing cartridge 23 is mounted in the developing cartridge housing part 26, and formed to be inclined obliquely upward toward the front along the lower end in the front portion of the front side walls 31.

The front wall 32 is provided with a roll 33 (see FIGS. 2 and 7), as one example of a positioning part, for positioning the developing cartridge 23 and a pressing mechanism part 34, as one example of a pressing part, for pressing the developing cartridge 23 toward the photosensitive drum 3.

The front wall 32 is also provided with a roll support part 35 for rotatably supporting the roll 33 in the central portion in the width direction, as shown in FIG. 2. The roll support part 35 is included in an image forming area 15 where the developer image is carried on the photosensitive drum 3, when projected onto the photosensitive drum 3.

Figure 7:
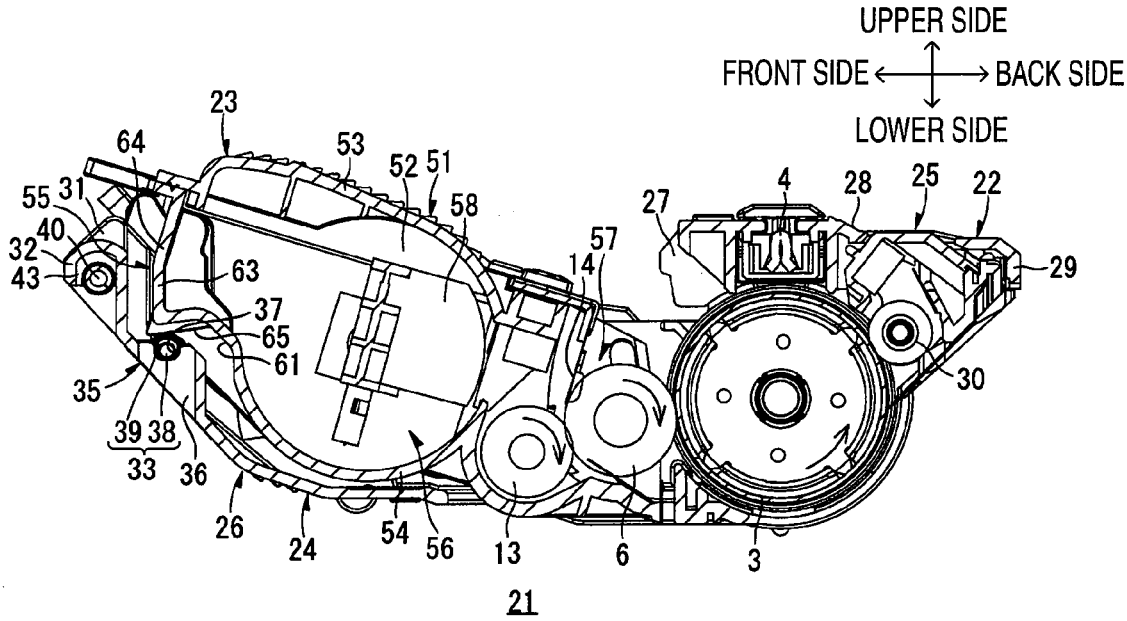
FIG. 7 is a cross-sectional view, taken along the line VII-VII of FIG. 2.

The roll support part 35 is provided halfway in the front-back direction of the front wall 32 inclined obliquely upward toward the front, as shown in FIG. 7.

The roll support part 35 comprises a plurality of support plates 36 protruding upward from the front wall 32. The support plates 36 are disposed with a gap in the width direction, an upper edge of the gap being formed in a shape of a straight line along the front-back direction. A bearing part 37, which is cut away downward like a circular arc in the center in the front-back direction, is formed at the upper edge of the support plate 36.

The roll 33 comprises a shaft 38 and a roller 39 provided around the shaft 38. The roll 33 is supported on the roll support part 35 by both end portions of the shaft 38 rotatably borne on the bearing part 37.

Figure 6:
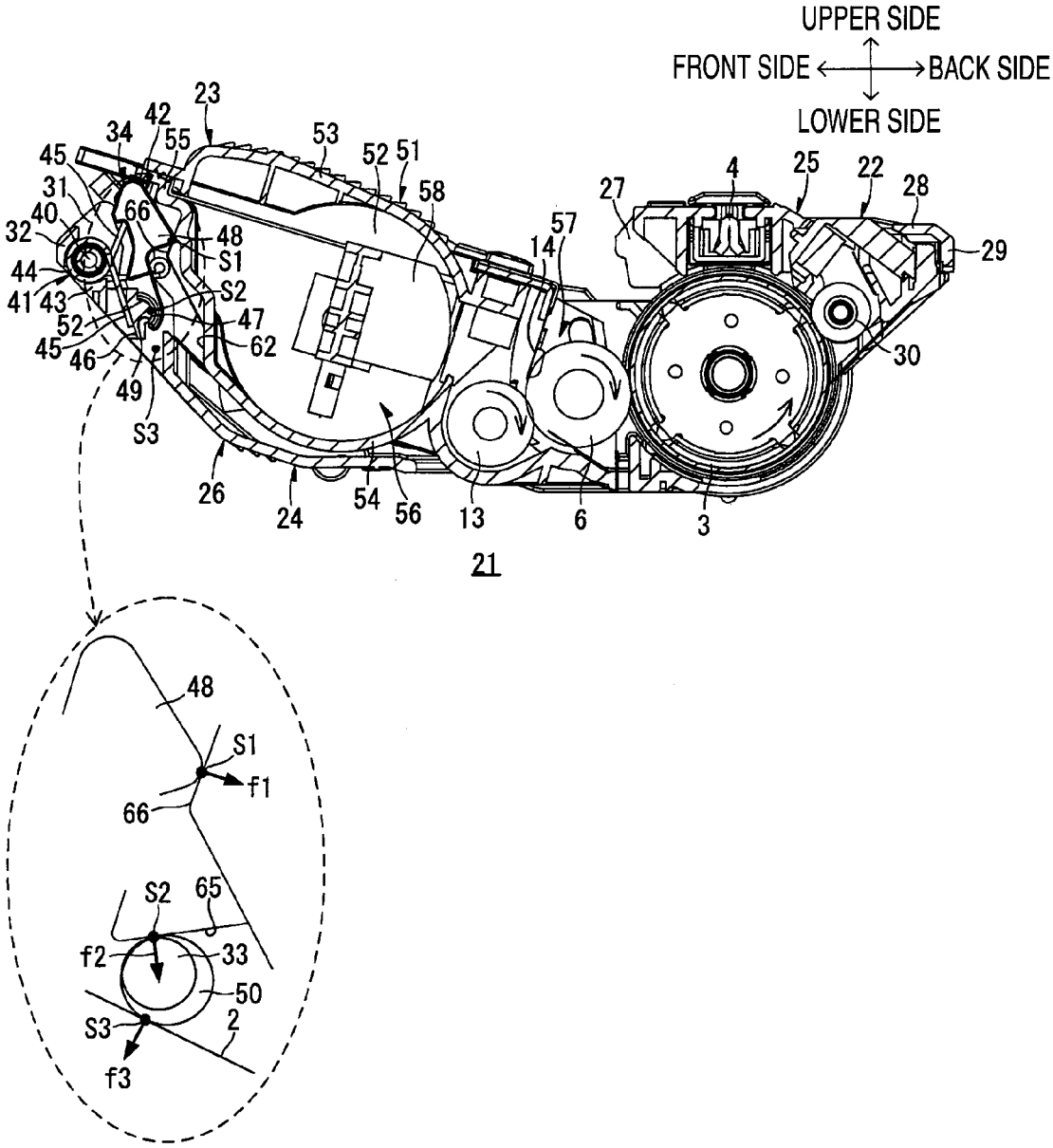
FIG. 6 is a cross-sectional view, taken along the line VI-VI of FIG. 2.

The pressing mechanism part 34 comprises a support shaft 40, a coil spring 41, as one example of an urging member, and a pressing lever 42, as one example of a pressing member, as shown in FIG. 6.

At a front end portion of the front wall 32, an insertion part 43 for inserting the support shaft 40 is provided over the entire width in the width direction, as shown in FIG. 4. The support shaft 40 is inserted through the insertion part 43, and provided to extend over the entire width in the width direction (i.e., a same direction as a direction of rotation axis of the developing roller 6) at the front end portion (i.e., the end portion on the opposite side of the developing roller 6 from the photosensitive drum 3) of the front wall 32. The support shaft 40 is, for example, made of metal such as iron. For example, a pipe shaft may be used as the support shaft 40. Although the insertion part 43 and the support shaft 40 have been described as extending over the entire width of the front wall 32, it is alternatively possible to provide the insert part 43 and the support shaft 40 at a middle portion of the front wall 32.

A coil spring 41 and a pressing lever 42 are provided at two portions with a gap in between the two positions in the width direction, symmetrically around the center in the width direction, at the front end portion of the front wall 32, as shown in FIG. 2. The coil spring 41 and the pressing lever 42 are both included in the image forming area 15, when projected onto the photosensitive drum 3.

The coil spring 41 comprises a winding part 44 and end portions 45 continuous from the winding part 44, as shown in FIG. 6. The winding part 44 of the coil spring 41 is inserted and supported through the support shaft 40 at the two portions as described above, one end portion 45 thereof being engaged with an engagement part 46 formed backward of the insertion part 43 in the front wall 32.

The pressing lever 42 comprises a pressing protrusion 48 formed in a shape bulging backward on the upper side. The pressing protrusion 48 is formed with a swing hole 49 at a lower end portion of the pressing protrusion 48. On the front wall 32, an insertion shaft 47 extending along the width direction is provided behind the engagement part 46. The pressing lever 42 is swingably supported by the insertion shaft 47 that is inserted into the swing hole 49. The other end 45 of the coil spring 41 is welded from the front side with the pressing protrusion 48, so that the pressing protrusion 48 is urged backward.

The front wall 32 is provided with a boss 50, as one example of a support part, supported on the body casing 2, when the drum cartridge 22 is mounted to the body casing 2, as shown in FIGS. 2 and 4.

The boss 50 is provided at end portions of the front wall 32 in the width direction and projects outward in the width direction, and is provided below the insertion part 43.

Each boss 50 is supported on the body casing 2 by a support member (not shown) provided on the body casing 2, when the drum cartridge 22 is mounted to the body casing 2, whereby the drum cartridge 22 is positioned in the body casing 2.

(2) Developing Cartridge

Figure 5:
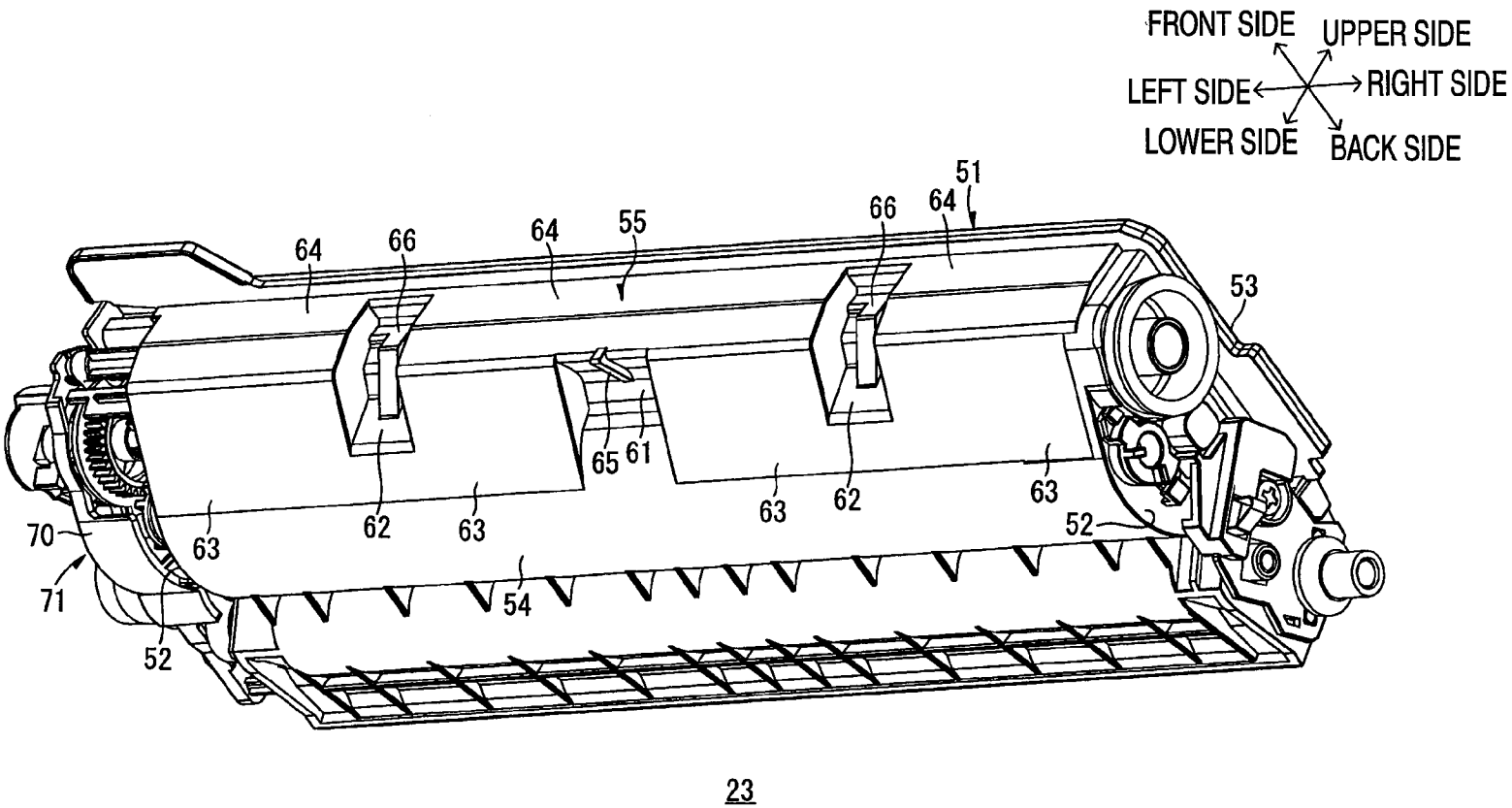
FIG. 5 is a perspective view of a developing cartridge of the process cartridge of FIG. 3, as viewed from a front bottom side.

The developing cartridge 23 comprises a housing 51, as shown in FIGS. 5 and 6. The housing 51 is formed in the shape of a box that is opened on the back side. The housing 51 comprises side walls 52 disposed opposed to each other with a gap in the width direction therebetween, an upper wall 53 built on the upper edge of the side walls 52, a bottom wall 54 built on the lower edge of the side walls 52, and a front wall 55 built on the front edge of the side walls 52.

A front space of the housing 51 is partitioned as a developer accommodating chamber 56 for accommodating developer, and a back space is partitioned as a developing chamber 57 in which the developing roller 6 is provided.

The developer accommodating chamber 56 is filled with the developer, and an agitator 58 is rotatably provided in the center in the front-back direction and the up-down direction. A bottom wall 54 of the developer accommodating chamber 56 is formed like a circular arc along a rotation locus of the agitator 58.

The developing chamber 57 is provided with a supply roller 13 and a layer thickness regulation blade 14, together with the developing roller 6. The developing roller 6 is rotatably supposed on both side walls 52 to be exposed from behind the housing 51. The supply roller 13 is rotatably supported on both side walls 52 to contact the developing roller 6 on the front side of the developing roller 6. The layer thickness regulation blade 14 has an upper end portion supported by the upper wall 53, and a pressure contact rubber at a lower end portion positioned against the developing roller 6 from the front side.

In the developing cartridge 23, the developer filled in the developer accommodating chamber 56 is discharged into the developing chamber 57 with the rotation of the agitator 58 and supplied to the supply roller 13 when forming an image. Thereafter, the developer is supplied to the developing roller 6 with the rotation of the supply roller 13. The developer enters between the layer thickness regulation blade 14 and the developing roller 6 with the rotation of the developing roller 6 to be formed into a thin layer having a predetermined thickness. Thereby, the developer is carried as the thin layer on the surface of the developing roller 6.

The developing cartridge 23 is provided, on the front wall 55 thereof, with a roll receiving part 61, as one example of a fitting part, into which the roll 33 of the drum cartridge 22 is fitted and a lever receiving part 62, as shown in FIG. 5.

The front wall 55 comprises an inclined wall 63 continuous from a front end face of the bottom wall 54, and a vertical wall 64 continuous from the inclined wall 63.

A back end portion of the inclined wall 63 is connected to a front portion of the bottom wall 54. The inclined wall 63 is provided to be inclined obliquely upward from the back end portion toward the front.

The vertical wall 64 is provided along the up-down direction to connect a front end portion of the inclined wall 63 and a front end portion of the upper wall 53.

The roll receiving part 61 is provided in the center of the inclined wall 63 in the width direction in a position corresponding to the roll 33.

The roll receiving part 61 is made concave to be recessed in a shape rectangular in bottom view and trapezoidal in side view (refer to FIG. 7) recessed from the lower surface of the inclined wall 63. A roll receiving surface 65 contacted by the roll 33 is formed on the upper, inner side surface of the roll receiving part 61. The roll receiving surface 65 is disposed in the center of the roll receiving part 61 in the width direction, making a convex shape bulging downward from the upper, inner side surface of the roll receiving part and is provided along the front-back direction.

The lever receiving parts 62 are provided at two portions with a gap therebetween in the width direction, symmetrically around the center in the width direction, a position of the lever receiving parts 62 corresponding to a position of the pressing levers 42 provided at two portions, on the inclined wall 63. More specifically, the lever receiving parts 62 are provided at two portions across the roll receiving part 61 on the inclined wall 63.

The lever receiving part 62 has a rectangular shape in bottom view and front view, and is made concave to be recessed upward from the lower surface of the front side portion of the inclined wall 63, and recessed backward from the front surface of the vertical wall 64. Thereby, the lever receiving part 62 is formed so that two triangles may be connected in side view, as shown in FIG. 6.

A pressing surface 66, as one example of a pressed part, which is pressed against the pressing protrusion 48 is provided on the recessed concave surface of the lever receiving part 62, as shown in FIG. 5.

The pressing surface 66 is convex in the shape of a T-character in front view bulging forward from the concave surface of the lever receiving part 62, with a surface of the pressing surface 66 being formed along the front-back direction and the width direction in a portion recessed from the vertical wall 64.

Figure 8A:
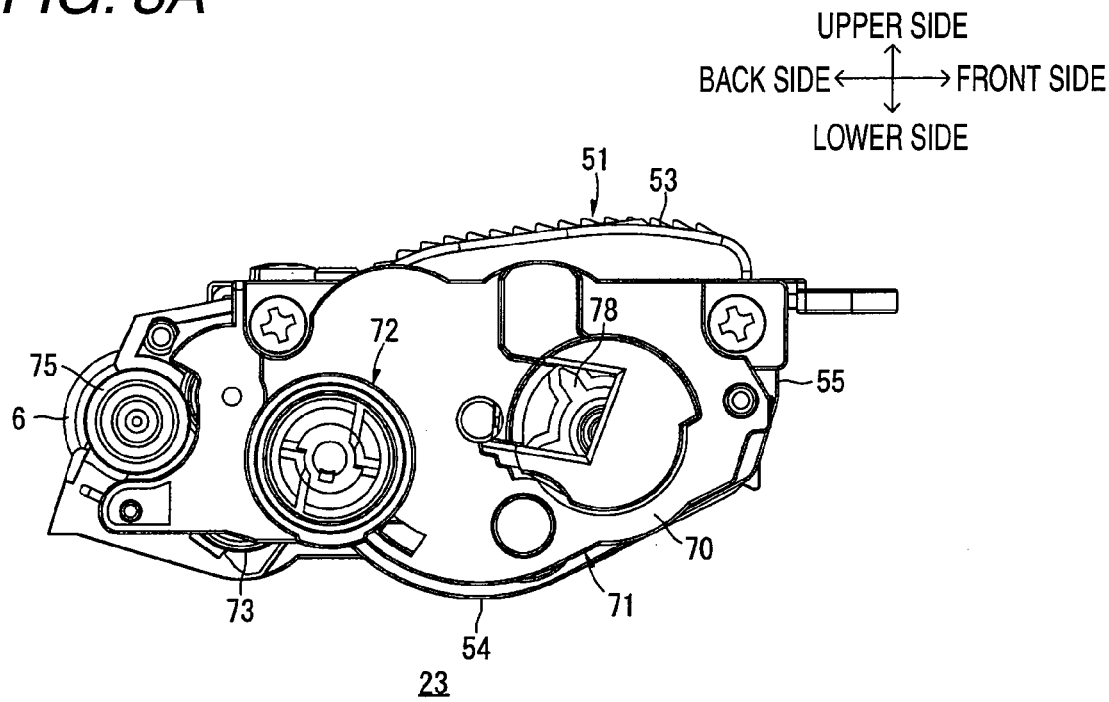
Figure 8B:
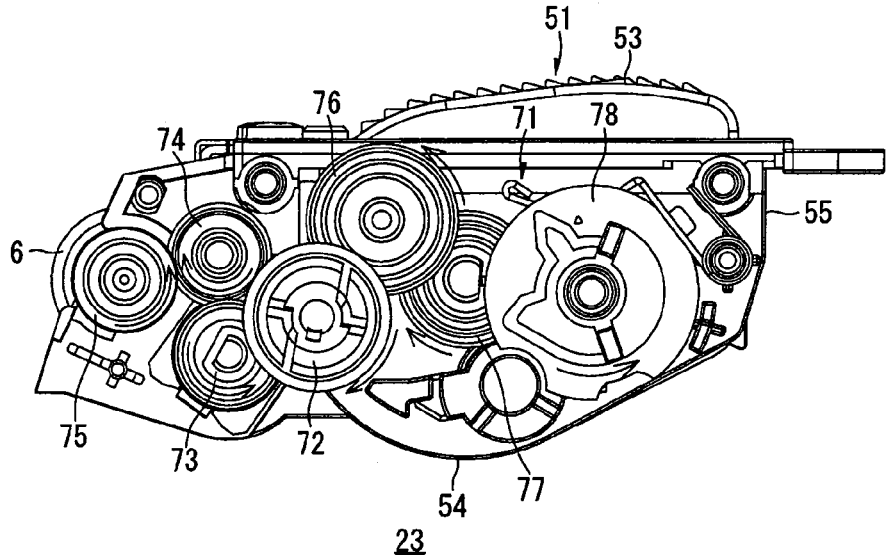

A gear cover 70 as shown in FIG. 8A and a gear mechanism part 71 covered by the gear cover 70 as shown in FIG. 8B are provided on the left side walls 52 of the housing 51. The gear mechanism part 71 is provided with the input gear 72, as one example of driving force input member, a supply roller gear 73, a first idle gear 74, a developing roller gear 75, a second idle gear 76, an agitator gear 77, and a detection gear 78. The driving force input member transmits a driving force to the developing roller 6.

The input gear 72 comprises the internal teeth with which an output gear (not shown) provided in the body casing 2 is connected to freely advance or retract, and the external teeth provided on the outer circumferential surface. The input gear 72 is disposed between the developer accommodating chamber 56 and the developing chamber 57, when projected along the width direction.

The supply roller gear 73 is provided in the supply roller 13, and meshed with the external teeth of the input gear 72 downward on the back of the input gear 72. The first idle gear 74 is meshed with the supply roller gear 73 above the supply roller gear 73. The developing roller gear 75 is provided in the developing roller 6, and meshed with the first idle gear 74 on the back side of the first idle gear 74.

The second idle gear 76 is meshed with the external teeth of the input gear 72 upward on the front side of the input gear 72. The agitator gear 77 is provided in the agitator 58, and meshed with the second idle gear 76 downward on the front side of the second idle gear 76. The detection gear 78 is the gear with missing tooth and meshed with the agitator gear 77 on the front side of the agitator gear 77.

The gear cover 70 covers the gear mechanism part 71 so that part of the input gear 72, the developing roller gear 75 and the detection gear 78 may be exposed.

If the input gear 72 receives a driving force from the output gear (not shown), the input gear 72 is rotated clockwise in left side view. And the driving force transmitted to the input gear 72 is transmitted to the supply roller gear 73, so that the supply roller 13 is rotated counterclockwise in left side view.

Further, the driving force transmitted to the supply roller gear 73 is transmitted via the first idle gear 74 to the developing roller gear 75, so that the developing roller 76 is rotated counterclockwise in left side view.

The driving force transmitted to the input gear 72 is transmitted via the second idle gear 76 to the agitator gear 77, so that the agitator 58 is rotated clockwise in left side view.

Further, the driving force transmitted to the agitator gear 77 is transmitted to the detection gear 78, whereby if the developing cartridge 23 is a new article, the detection gear 78 is rotated. The detection gear 78 is provided to detect whether the developing cartridge 23 is new or old, and rotated only if the developing cartridge 23 is the new article.

(3) Mounting Developing Cartridge to Drum Cartridge

The developing cartridge 23 is mounted to the developing cartridge housing part 26 of the drum cartridge 22, as shown in FIG. 3.

In the developing cartridge housing part 26 as shown in FIG. 7, the developing roller 6 contacts the photosensitive drum 3 on the back side, and the roll 33 is fitted (received) into the roll receiving part 61 on the front side, so that the roll 33 contacts the roll receiving surface 65. Thereby, the developing cartridge 23 is positioned in the developing cartridge accommodating part 26.

The pressing lever 42 is fitted (received) into the lever receiving part 62, so that the pressing protrusion 48 presses the pressing surface 66 backward, as shown in FIG. 6. Thereby, the developing cartridge 23 is urged toward the photosensitive drum 3, so that the developing roller 6 and the photosensitive drum 3 are welded.

If the developing cartridge 23 is mounted to the developing cartridge accommodating part 26, the roll receiving part 61 and the pressing surface 66 of the lever receiving part 62 are disposed on the opposite side of the developing roller 6 from the photosensitive drum 3 and included in the image forming area 15 when projected onto the photosensitive drum 3, as shown in FIG. 2.

As shown in FIG. 6, when projected in the direction of the rotation axis of the developing roller 6, namely, in the width direction, a pressing position S1, a fitting position S2, and a support position S3 are provided in succession in a counterclockwise direction. In the pressing position, the pressing surface 66 is pressed by the pressing protrusion 48. In the fitting position S2, the roll 33 contacts the roll receiving surface 65, and in the support position S3, the boss 50 (contact position of the boss 50 with the body casing 2) is provided.

When projected in the width direction, a distance in the counterclockwise direction, when viewed from the right side, between the fitting position S2 and the support position S3 is set shorter than a distance between the pressing position S1 and the fitting position S2.

The input gear 72 is disposed facing to the input gear opening part 67 in the width direction, the output gear (not shown) provided in the body casing 2 advances via the input gear opening part 67 to mesh with the internal teeth of the input gear 72.

If a driving force is input to the photosensitive drum 3, the photosensitive drum 3 is rotated in the same direction as the rotation direction of the input gear 72, i.e., counterclockwise in right side view, as shown in FIG. 6. After the surface of the photosensitive drum 3 is uniformly charged by the scorotron-type charger 4, the surface is exposed by the LED provided in the LED unit 5 to form an electrostatic latent image, as described above.

In contrast, the developing roller 6 is rotated clockwise as viewed from the right side owing to a driving force from the input gear 72, and thus is rotated in the same direction (from top to bottom) as the photosensitive drum 3 at the contact portion with the photosensitive drum 3, so that each electrostatic latent image is developed by the developer carried on the developing roller 6, when opposed to the developing roller 6, as shown in FIG. 6 and as described above.

If the developing cartridge 23 is mounted to the drum cartridge 22, the roll 33 is fitted (received) into the roll receiving part 61, so that the roll 33 contacts the roll receiving surface 65, whereby the developing cartridge 23 is positioned with respect to the drum cartridge 22, as described above. The pressing lever 42 is fitted (received) into the lever receiving part 62, the pressing protrusion 48 presses the pressing surface 66 backward, whereby the developing cartridge 23 is pressed toward the photosensitive drum 3.

The roll 33 is received in the roll receiving part 61. Accordingly, the size of the process cartridge 21 can be reduced in the up-down direction. Further, since the pressing lever 42 is received in the lever receiving part 62, the size of the process cartridge can be reduced in the front-back direction.

In the process cartridge 21, the roll receiving part 61 and the pressing surface 66 of the lever receiving part 62 are included in the image forming area 15, when projected onto the photosensitive drum 3. Therefore, the roll receiving part 61 and the pressing surface 66 of the lever receiving part 62 do not protrude out of the image forming area 15, whereby the size of the process cartridge can be reduced in the width direction.

Consequently, a total size of the process cartridge 21 can be reduced.

Further, in the developing cartridge 23, the roll receiving part 61 and the pressing surface 66 of the lever receiving part 62 are disposed on the opposite side of the developing roller 6 from the photosensitive drum 3. Therefore, even if the pressing protrusion 48 of the drum cartridge 22 presses the pressing surface 66 of the developing cartridge 23, the developing cartridge 23 can be stably supported by the drum cartridge 22.

In the process cartridge 21, the pressing position S1 at which the pressing surface 66 is pressed by the pressing protrusion 48, the fitting position S2 at which the roll 33 contacts the roll receiving surface 65, and the support position S3 at which the boss 50 is provided are arranged in succession along the rotation direction of the photosensitive drum 3, when projected in the width direction.

That is, the fitting position S2 at which the developing cartridge 23 is positioned in the drum cartridge 22 is adjacent to the support position S3 at which the drum cartridge 22 is supported on the body casing 2 in the rotation direction of the photosensitive drum 3, and further the pressing position S1 at which the developing cartridge 23 is pressed toward the photosensitive drum 3 is adjacent to the fitting position S2.

Therefore, a stable pressing of the pressing protrusion 48 against the pressing surface 66 and the stable positioning of the roll 33 in the roll receiving surface 65 can be achieved, and the stable support of the developing cartridge 23 on the drum cartridge 22 and the stable support of the process cartridge 21 on the body casing 2 can be achieved.

More specifically, if a driving force from the output gear (not shown) is inputted into the input gear 72, there occurs a rotational force clockwise in left side view around the input gear 72 in the developing cartridge 23, as shown in FIG. 8. That is, there occurs a rotational force of the developing cartridge 23 directed from top to bottom on the front side of the developing cartridge 23, so that a pressing force f2 directed downward from the roll receiving surface 65 acts on the roll 33, as shown in FIG. 6.

However, the fitting position S2 is placed on the downstream side of the pressing position S1 in the rotational direction of the photosensitive drum 3. Therefore, at the fitting position S2, a portion of the pressing force f1 with which the developing cartridge 23 is pressed against the photosensitive drum 3 at the pressing position S1, and a portion of the pressing force f2 acting on the roll from the roll receiving surface 65 can be securely received by the roll 33.

Further, the drum cartridge 22 subjected to the rotational force of the developing cartridge 23 produces another rotational force, so that a pressing force f3 from the boss 50 directed downward in a similar general direction as the pressing force f2 acts on the body casing 2 which accepts the boss 50.

However, the support position S3 is placed on the downstream side of the fitting position S2 in the rotational direction of the photosensitive drum 3. Therefore, at the support position S3, the pressing force f3 from the boss 50 can be securely received by the body casing 2.

Consequently, a stable pressing of the pressing protrusion 48 against the pressing surface 66 and a stable positioning of the roll 33 on the roll receiving surface 65 can be achieved, and a stable support of the developing cartridge 23 on the drum cartridge 22 and a stable support of the process cartridge 21 on the body casing 2 can be achieved.

Since the distance between the fitting position S2 and the support position S3 is shorter than the distance between the fitting position S2 and the pressing position S1, the developing cartridge 23 can be positioned at a position near the support position S3 in the drum cartridge 22. Therefore, the developing cartridge 23 can be supported more stably by the drum cartridge 22, and the process cartridge 21 can be supported more stably by the body casing 2.

The pressing mechanism part 34 is disposed at the front end portion of the drum cartridge 22. Therefore, even if the pressing surface 66 of the developing cartridge 23 is pressed by the pressing protrusion 48, the developing cartridge 23 can be supported more stably by the drum cartridge 22.

The support shaft 40 is provided at the front end portion of the drum cartridge 22 to extend over the entire width in the width direction. Therefore, the front end portion of the drum cartridge 22 can be reinforced, whereby the rigidity of the drum cartridge 22 can be increased.

In the drum cartridge 22, the developing cartridge 23 is positioned by bringing the roll 33 into contact with the roll receiving surface 65 of the developing cartridge 23. Therefore, a sliding resistance in mounting or removing the developing cartridge 23 to or from the drum cartridge 22 can be reduced. Therefore, it is possible to more smoothly mount or remove the developing cartridge 23 to or from the drum cartridge 22.

The image forming apparatus 1 includes the above-described process cartridge 21. Accordingly, the image forming apparatus 1 can also be downsized.

(Modified Exemplary Embodiments)

The above-described exemplary embodiments of the invention have been described in relation to a direct tandem type color printer having four photosensitive drums. Alternatively, the invention may be applied to all kinds of printers, for example, to an intermediate transfer tandem type color printer and a monochrome printer.

Also, the exemplary embodiments have been described with respect to four process cartridges relating to four colors. However, the number of colors, and hence process cartridges, may be more or less than four.

Moreover, in the above-described exemplary embodiments, the support shaft 40 is provided at the front end portion of the drum cartridge 22 to extend over the entire width in the width direction. However, it is also possible to provide the support shaft 40 along only a portion of the front end portion of the drum cartridge 22.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. A process cartridge comprising:

a developing cartridge comprising a developer carrier, a fitting part, and a pressed part; and a photosensitive cartridge, to which the developing cartridge is removably mounted, the photosensitive cartridge comprising:

a photosensitive member;

a positioning part which is fitted into the fitting part for positioning the developing cartridge; and a pressing part which contacts the pressed part for pressing the developing cartridge toward the photosensitive member, wherein the positioning part and the pressing part are provided longitudinally in an area in a longitudinal direction of the photosensitive member corresponding to an area on the photosensitive member in which a developer image is formed, wherein the developing cartridge comprises a first end portion and a second end portion opposite to the first end portion, wherein the developer carrier is provided at the first end portion, and wherein the fitting part and the pressed part are provided at the second end portion.

2. The process cartridge according to claim 1, wherein the photosensitive cartridge further comprises a support part that extends in the widthwise direction from a side of the process cartridge, wherein the process cartridge further comprises:

a pressing position at which the pressed part is pressed by the pressing part;

a fitting position at which the positioning part is fitted into the fitting part; and a support position at which the support part is supported, and wherein the pressing position, the fitting position and the support position are arranged in order when viewed from a side of the process cartridge.

3. The process cartridge according to claim 2, wherein a distance between the fitting position and the support position is shorter than a distance between the fitting position and the pressing position.

4. The process cartridge according to claim 1, wherein the photosensitive cartridge comprises a first end portion and a second end portion opposite to the first end portion, and wherein the pressing part comprises:

a support shaft that is provided at the second end portion of the photosensitive cartridge and extends parallel to a rotation axis of the developer carrier;

an urging member supported on the support shaft; and a pressing member urged toward the developing cartridge by the urging member.

5. The process cartridge according to claim 4, wherein the support shaft comprises a pipe shaft made of metal.

6. The process cartridge according to claim 1, wherein the positioning part comprises a roll.

7. An image forming apparatus comprising:

a process cartridge including a developing cartridge comprising a developer carrier, a fitting part, and a pressed part; and a photosensitive cartridge, to which the developing cartridge is removably mounted, the photosensitive cartridge comprising:

a photosensitive member;

a positioning part which is fitted into the fitting part for positioning the developing cartridge; and a pressing part which contacts the pressed part for pressing the developing cartridge toward the photosensitive member, wherein the positioning part and the pressing part are provided longitudinally in an area in a longitudinal direction of the photosensitive member corresponding to an area on the photosensitive member in which a developer image is formed, wherein the developing cartridge comprises a first end portion and a second end portion opposite to the first end portion, wherein the developer carrier is provided at the first end portion, and wherein the fitting part and the pressed part are provided at the second end portion; and a main body.

8. The image forming apparatus according to claim 7, wherein the process cartridge comprises a first end portion and a second end portion opposite to the first end portion, and wherein the pressing part comprises:

a support shaft that is provided at the second end portion of the photosensitive cartridge and extends parallel to a rotation axis of the developer carrier;

an urging member supported on the support shaft; and a pressing member urged toward the developing cartridge by the urging member.

9. The image forming apparatus according to claim 8, wherein the support shaft comprises a pipe shaft made of metal.

10. A developing cartridge comprising:

a housing;

a developer carrier;

a fitting part that is provided at the center in a widthwise direction of the housing and is recessed within the housing for positioning the developing cartridge; and a pressed part that is provided between the fitting part and a side of the developing cartridge to receive a pressing force, wherein the housing comprises a first end portion and a second end portion opposite to the first end portion, wherein the developer carrier is provided at the first end portion, and wherein the fitting part and the pressed part are provided at the second end portion.

11. A photosensitive cartridge comprising:

a front wall;

a back wall;

two front side walls, one front side wall provided on each side of the front wall and attached to the front wall;

two back side walls, one back side wall provided on each side of the back wall and each of the two back side walls attached to a respective one of the two front side walls and to the back wall;

a photosensitive member supported in the photosensitive cartridge by the two back side walls;

a positioning part which is recessed in the front wall in a widthwise direction of the front wall; and a pressing part which is positioned between the positioning part and one of the front side walls and attached to the front wall on a side of the front wall facing the photosensitive member.

12. The photosensitive cartridge according to claim 11, wherein the positioning part is a roll which is provided in substantially the center in the widthwise direction of the front wall.

13. The photosensitive cartridge according to claim 12, wherein the pressing part comprises a pressing lever, a pressing protrusion, and a coil spring.

14. The photosensitive cartridge according to claim 13, further comprising:

a support shaft provided in the front wall, an axis of the support shaft being parallel to an axis of the photosensitive member; and an insertion part fitted into the support shaft, wherein the pressing part is attached to a portion of the insertion part.

15. The photosensitive cartridge according to claim 11, wherein each of the front side walls comprises a support part which extends in the widthwise direction from the side of the front side wall.

* * * * *